US006421836B1

(12) United States Patent
Park

(10) Patent No.: US 6,421,836 B1
(45) Date of Patent: Jul. 23, 2002

(54) GOLF GLOVE WITH TEE POCKET

(76) Inventor: Robert Tae-Boo Park, Daelim Apt. 121-701, 317-40, Haengdang-Dong, Seongdong-Ku, Seoul (KR)

( * ) Notice: Subject to any disclaimer, the term of this patent is extended or adjusted under 35 U.S.C. 154(b) by 0 days.

(21) Appl. No.: 09/776,778

(22) Filed: Feb. 6, 2001

(30) Foreign Application Priority Data

Feb. 12, 2000 (KR) ..... 00-3713

(51) Int. Cl.[7] ..... A63B 71/14
(52) U.S. Cl. ..... 2/161.4; 2/161.2
(58) Field of Search ..... 2/161.2, 161.1, 2/161.4, 160, 917; 224/218, 219, 918

(56) References Cited

U.S. PATENT DOCUMENTS 3,629,867 A * 12/1971 Taylor
5,365,609 A * 11/1994 Herzog
D356,657 S * 3/1995 Hauswald
D436,641 S * 1/2001 Todd et al.
6,205,588 B1 * 3/2001 Shin

FOREIGN PATENT DOCUMENTS

JP 8-322978 * 12/1996
JP 8-332257 * 12/1996

* cited by examiner

*Primary Examiner*—Rodney M. Lindsey
(74) *Attorney, Agent, or Firm*—Bacon & Thomas, PLLC

(57) ABSTRACT

A golf glove, having tee pockets on its fastening band. The tee pockets may be formed between the internal and external sheets of the double ply fastening flap or between the surface of the glove body and the flap interlocking patch. The tee insert holes and the tee pockets are formed on the flat interlocking patch of the fastening band. The tee pockets are formed between the flap interlocking patch and the surface of the glove body such that the tee pockets extend in a direction perpendicular to the axial direction of the glove body. An elastic band is attached on the interior surface of the external sheet of the fastening flap in a direction along the tee insert holes so as to elastically hold the golf tees set in the tee pockets.

1 Claim, 6 Drawing Sheets

GOLF GLOVE WITH TEE POCKET

BACKGROUND OF THE INVENTION

1. Field of the Invention

The present invention relates, in general, to a golf glove having a tee pocket on its fastening band consisting of a fastening flap and a flap interlocking patch and, more particularly, to a golf glove having a plurality of tee pockets provided on the fastening flap or flap interlocking patch of the band such that the pockets extend in a direction perpendicular to an axial direction of the glove body, the golf glove thus allowing a golfer to store a plurality of golf tees in the tee pockets.

2. Description of the Prior Art

Most golfers typically wear golf gloves for preventing the grip of a golf club from unexpectedly slipping from his hands while golfing. A golf tee is a small wooden, plastic, metal, or rubber peg from which the ball is driven, as in teeing off at the beginning of play for each hole. Such a tee is stuck into the teeing ground and holds a golf ball thereon.

It is thus necessary for golfers to always bring several tees while golfing on a course. Most golfers store their tees in the pockets of their golf trousers, and take out a desired tee from the pocket when necessary.

As described above, the conventional tees have been typically made of wood, plastic, metal or rubber, and have a peg shape with a sharpened tip. The tees may thus undesirably irritate the golfer's body when they are stored in the pockets of trousers. Such storage of golf tees in a trouser pocket also prevents a golfer from quickly or easily taking out a desired tee from the pocket since the golfer typically stores other necessities, such as ball markers, in the trouser pocket together with the tees. Therefore, the storage of golf tees in trouser pockets is inconvenient for golfers.

In an effort to allow a golfer to simply and conveniently store his tees and easily and quickly take out a desired tee while golfing on the course, a golf glove having a tee holder on its fastening band, consisting of a fastening flap and a flap interlocking patch provided on the back of the glove, has been proposed and widely used. An example of a conventional golf glove having such a tee holder is shown in FIGS. 1 and 2.

FIG. 1 is a perspective view, showing the construction of a conventional golf glove with a fixed tee holding band provided on the fastening flap of the fastening band as disclosed in Korean Utility Model Registration No. 108,796. In this conventional golf glove, a slit 12 is formed on the sleeve of the glove body 11 along an axial direction of the body 11 and allows a hand of a golfer to easily pass through the sleeve when putting on or taking off the glove. The fastening flap 13*a* of a fastening band 13 is mounted to an edge of the slit 12, and extends from said edge toward the back of the glove body 11. A flap interlocking patch 13*b* of the band 13 is attached on the surface of the glove body 11 at a position corresponding to the fastening flap 13*a*. The flap 13*a* and patch 13*b* of the fastening band 13 are provided with fastening means, such as the hook and pile pieces of a Velcro fastener, on their opposing surfaces, thus interlocking when pressed together. A tee holding band 14 is fixed to the external surface of the fastening flap 13*a* through a sewing process to form a plurality of tee holders 14*a*.

In such a case, the tee holders 14*a* of the tee holding band 14 are arranged in parallel to the axial direction of the glove body 11, and keep a plurality of tees (not shown) therein.

FIG. 2 is a perspective view, showing the construction of another conventional golf glove with a removable tee holding band provided on the fastening flap of the fastening band as disclosed in Korean Utility Model Publication No. 96-1105. In this golf glove, the pile or hook piece 23 of a Velcro fastener is attached to the top surface of the fastening flap 22 of a fastening band 21 mounted to the back of the glove body 20. This golf glove also has a removable tee holding band 24 provided with a plurality of tee holders for holding a plurality of tees "T". The lower surface of this tee holding band 24 is provided with the remaining piece of the Velcro fastener. The tee holding band 24 is thus capable of detachably interlocking with the fastening flap 22 when pressed together.

That is, in the golf glove of FIG. 2, the pile or hook piece 23 of a Velcro fastener is mounted to the top surface of the fastening flap 22 of the fastening band 21. On the other hand, the remaining piece of the Velcro fastener is mounted to the lower surface of the tee holding band 24 with a plurality of tee holders 24*a* formed on the band 24 through a sewing process, Therefore, the tee holding band 24 removably interlocks with the top surface of the fastening flap 22 when pressed together as desired.

The above-mentioned golf gloves have a fixed or removable tee holding band 14 or 24 on the fastening band 13 or 21 of the glove body 11 or 20 as shown in FIGS. 1 and 2, and so the gloves allow users to easily and conveniently store and remove the golf tees while golfing on a course. However, these golf gloves are problematic as follows:

That is, the tee holding bands 14 and 24 are fixed to or detachably attached to the external surface of the fastening flap of the fastening band such that the bands 14 and 24 are entirely exposed to the atmosphere. Therefore, some golfers unconsciously see their tee holding bands in addition to the tees held in the holding bands while addressing the head of a club or hitting a ball on the course. Particularly, when a golfer unconsciously sees his tee holding band in addition to the tees held in the band while addressing the head of a club behind a ball, he may fail to focus his mind upon the addressing, thus being apt to miss a precise shot.

In addition, it is necessary for golfers to use a variety of tees having different lengths in accordance with the size of holes, and most golfers prefer to bring a plurality of tees including long and short tees so as to selectively use desired ones on the course. The average length of conventional long tees reaches about 7 cm. It is also necessary for each golfer to actively change his wrist angle while driving or hitting a ball on the course. When a golfer, putting on a glove with such several tees having different lengths and held on the conventional tee holding band of the glove, hits or drives a ball while such actively changing his wrist angle, the heads of some tees, for example, long tees, irritate or press against the golfer's wrist, thus distracting the golfer from precisely driving or hitting.

On the other hand, when a right-handed golfer uses a golf glove having such a conventional tee holding band, he wears the glove on his left hand. Therefore, such a right-handed golfer must handle the tees with a right hand when it is desired to insert a tee into the holding band or take out a tee from the holding band. However, the conventional tee holding bands are designed such that the tee holders extend in parallel to the axial direction of the glove body or the axial direction of the left hand of a golfer, and so the direction of the tee holders does not match the physical structure of a right-handed golfer. Therefore, the golf gloves with such conventional tee holding bands are inconvenient for the right-handed golfers while handling the tees on such tee holding bands of the gloves.

Most golfers typically take off their gloves and hold the gloves in pockets while moving from one hole to another hole on the course. When the removable tee holding band and the glove of FIG. 2 are kept in a pocket while being separated from each other, the pile and hook pieces of the Velcro fastener of the tee holding band and the glove may be caught by the interior surface of the pocket, and so it is not easy to remove them from the pocket. In addition, the removable tee holding band may be undesirably removed from the glove even when a golfer pulls the fastening flap from the flap interlocking patch so as to unfasten the fastening band. Another disadvantage experienced in such conventional golf gloves resides in that they have Velcro fasteners, thus increasing the number of parts of the gloves, complicating the process of manufacturing the gloves, and increasing the production cost of the gloves.

SUMMARY OF THE INVENTION

Accordingly, the present invention has been made keeping in mind the above problems occurring in the prior art, and an object of the present invention is to provide a golf glove, which has a tee pocket on its fastening band consisting of a fastening flap and a flap interlocking patch, the tee pocket being designed to cover the tees except for the heads of the tees and allow the tees to be set in the pocket in a direction perpendicular to the axial direction of the glove, thus allowing a golfer to easily and conveniently handle the tees while inserting the tees into the pocket or taking out the tees from the pocket.

Another object of the present invention is to provide a golf glove, which has a tee pocket formed on its fastening band by forming one or more tee insert holes on the double ply fastening flap or the flap interlocking patch of the fastening band and partitioning the fastening band into isolated sections corresponding to the tee insert holes through a sewing process, and which forms the desired tee pocket without a separate tee holding band different from conventional golf glove.

In order to accomplish the above object, the primary embodiment of the present invention provides a golf glove, comprising one or more tee insert holes regularly formed on the external sheet of the double ply fastening flap of a fastening band along the outside edge of the flap, and one or more tee pockets formed between the internal and external sheets of the fastening flap at positions corresponding to the tee insert holes, the tee pockets extending in a direction perpendicular to the axial direction of the glove body.

In accordance with the second embodiment, the tee insert holes and the tee pockets are formed on the flat interlocking patch of the fastening band in place of the fastening flap. Of course, the fastening flap and the flap interlocking patch of the fastening band are designed to interlock when pressed together.

In this second embodiment, the tee pockets are formed between the flap interlocking patch having the pile or hook piece of a Velcro fastener and the surface of the glove body at positions corresponding to the tee insert holes such that the tee pockets extend in a direction perpendicular to the axial direction of the glove body.

In the golf glove of the present invention, the fastening flap of the fastening band is mounted to the edge of a slit formed on the sleeve of the glove body. This fastening flap is provided with the pile piece of a Velcro fastener on its lower surface. The hook piece of the Velcro fastener is attached to the back of the glove body at a position corresponding to the pile piece of the fastening flap, thus forming the flap interlocking patch. Therefore, the fastening flap having the pile piece of the Velcro fastener interlocks with the flap interlocking patch having the hook piece of the Velcro fastener when pressed together. Due to the fastening band, it is possible for a user to easily and conveniently put on or take off the golf glove when necessary, as well known to those skilled in the art.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
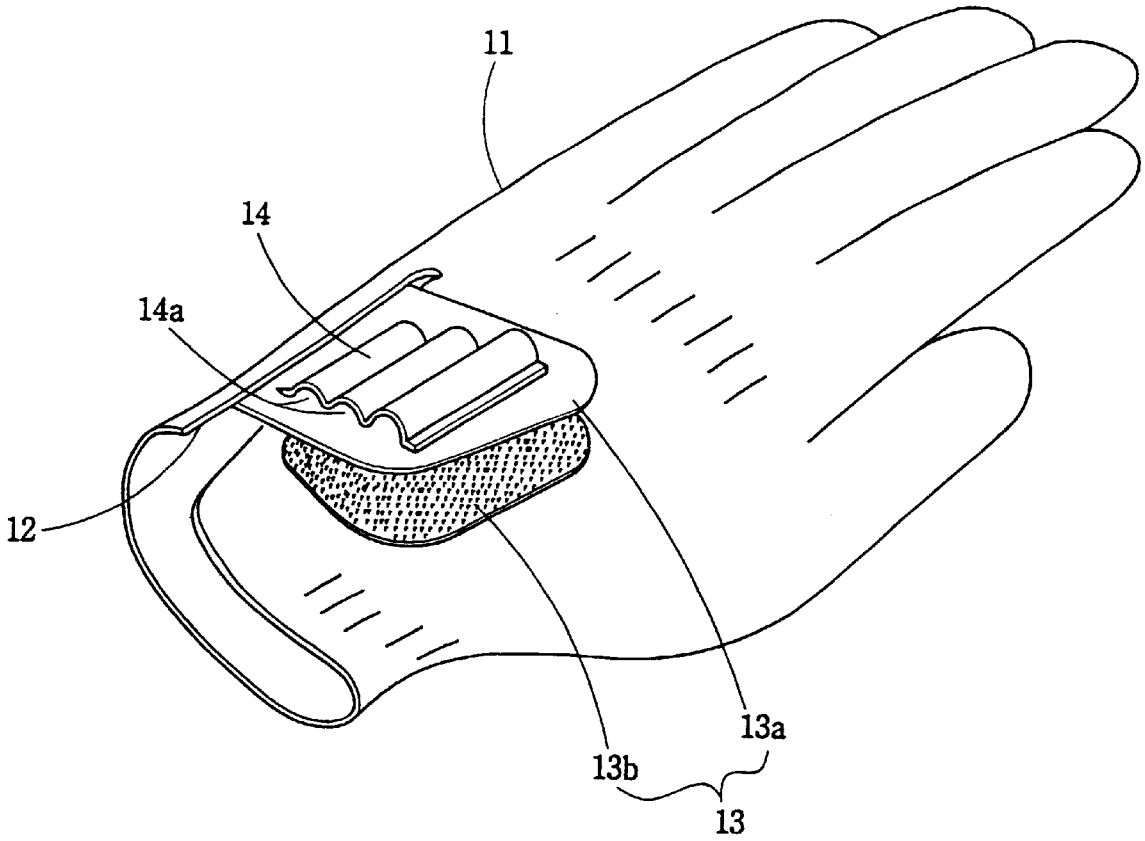
Fig. 1 PRIOR ART
FIG. 1 is a perspective view of a conventional golf glove with a fixed tee holding band.
Figure 2:
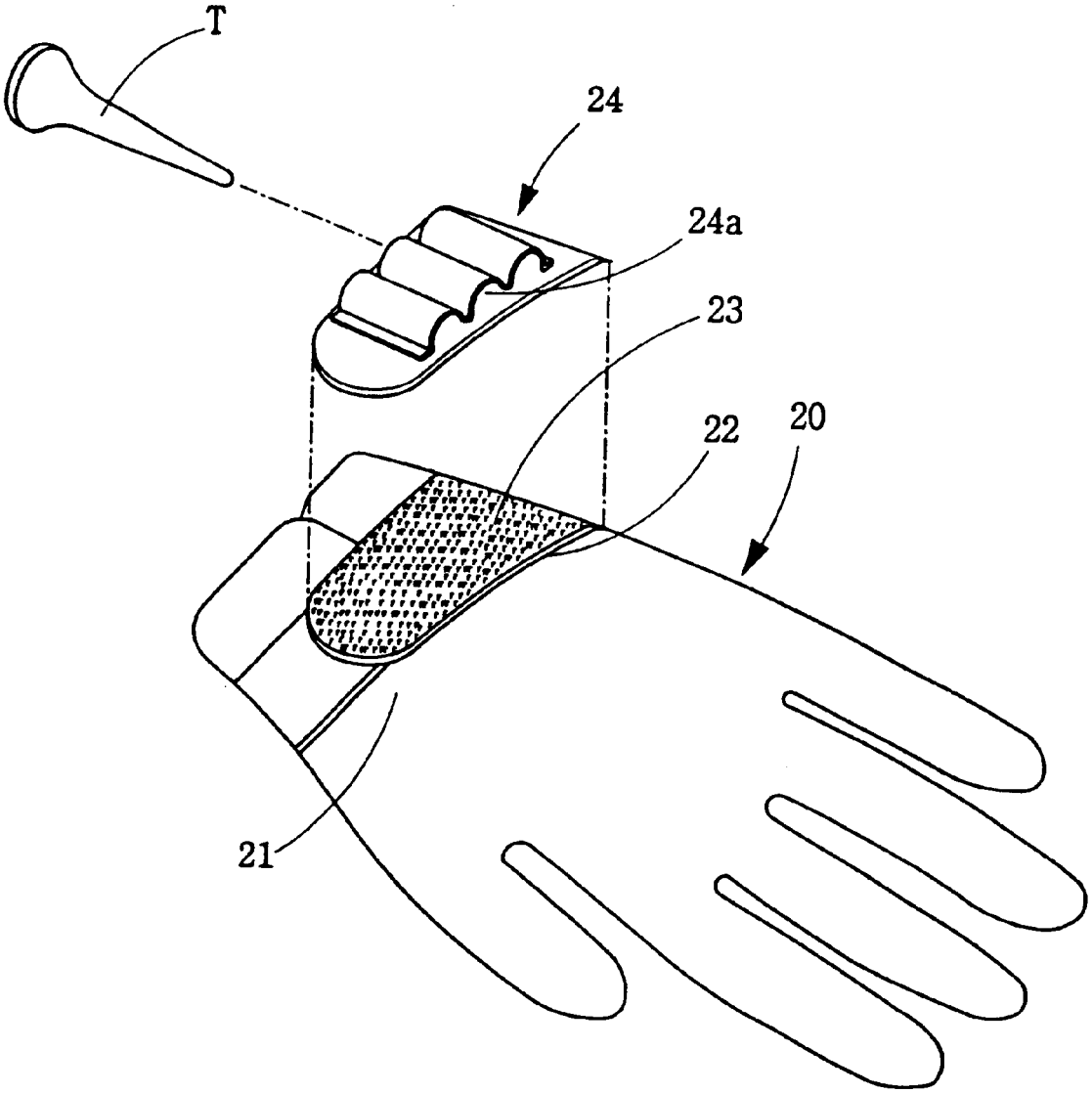
Fig. 2 PRIOR ART
FIG. 2 is a perspective view of a conventional golf glove with a removable tee holding band.
Figure 3:
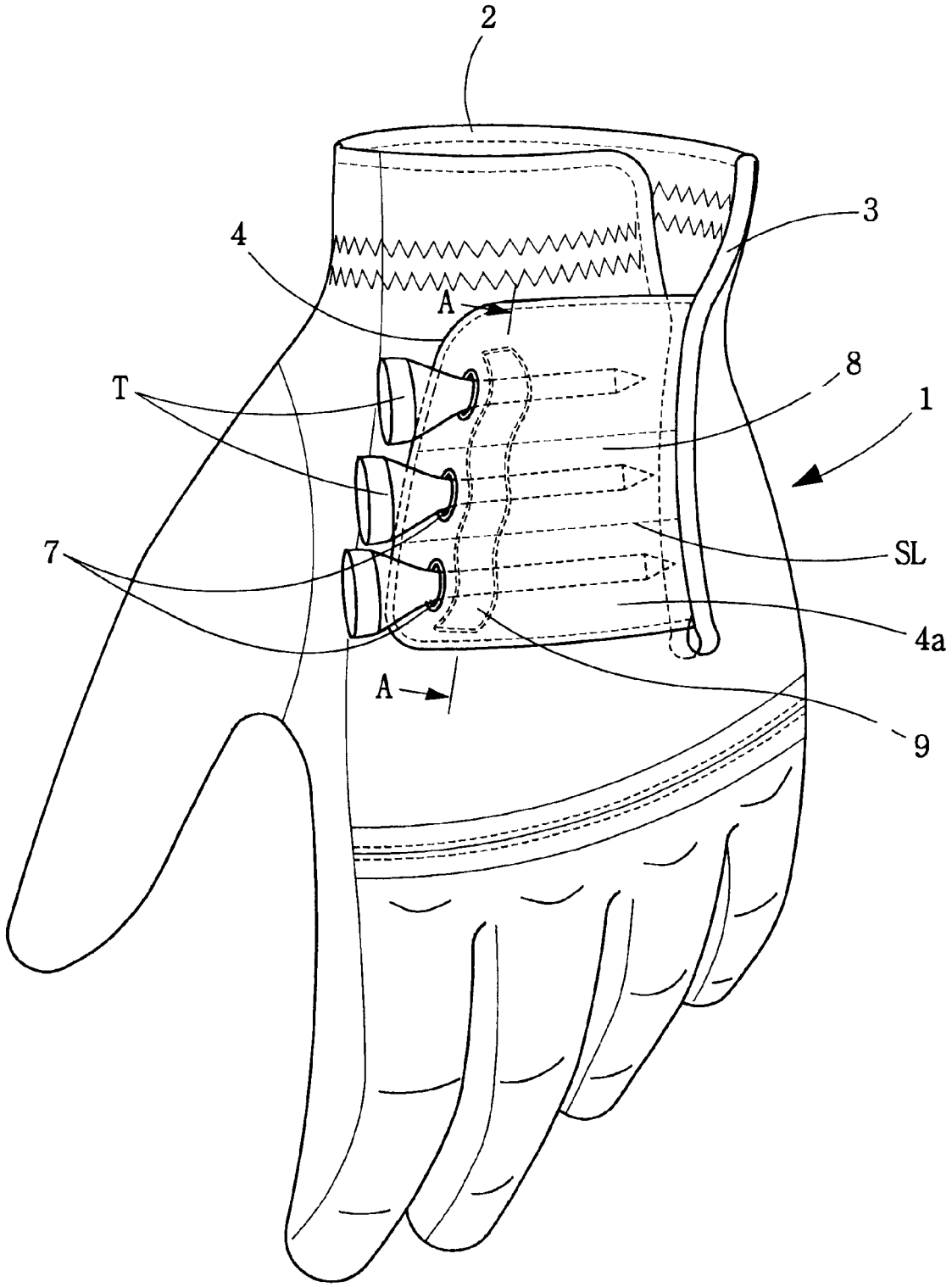
FIG. 3 is a perspective view of a golf glove with a tee pocket in accordance with the primary embodiment of the present invention.
Figure 4:
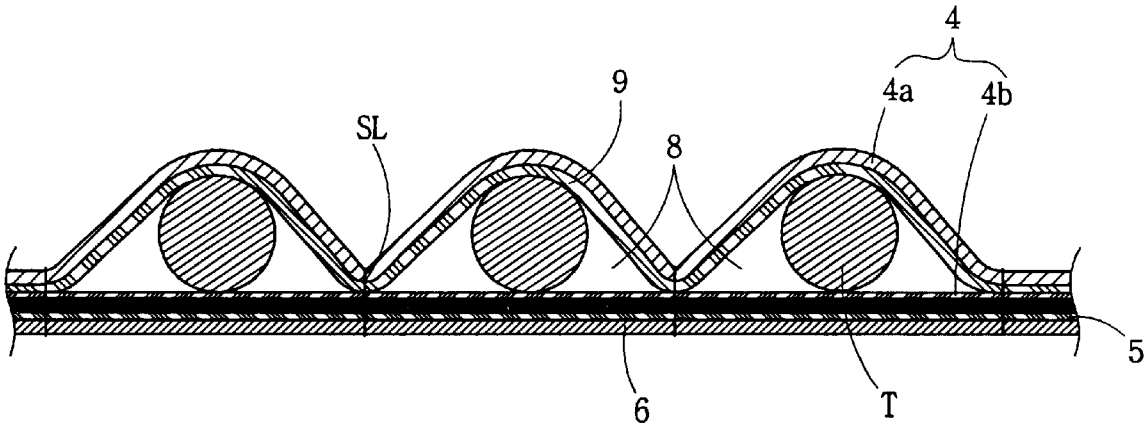
FIG. 4 is a sectional view of the golf glove according to the primary embodiment of this invention taken along the line A—A of FIG. 3.

FIG. 3 is a perspective view of a golf glove with a tee pocket in accordance with the primary embodiment of the present invention. FIG. 4 is a sectional view of the golf glove taken along the line A—A of FIG. 3.

As shown in the drawings, the golf glove according to the primary embodiment of this invention comprises a slit 3, which is formed on the sleeve 2 of the glove body 1 along an axial direction of the body 1 and allows a hand of a user to easily pass through the sleeve 2 when putting on or taking off the glove. A fastening flap 4, having a double ply structure with internal and external sheets, is mounted to the edge of said slit 3 such that the flap 4 extends in a direction perpendicular to the axial direction of the body 1. A flap interlocking patch 5 is attached on the surface 6 of the glove body 1 at a position corresponding to the fastening flap 4. This patch 5 has a fastening means for interlocking with the fastening flap 4 when pressed together. One or more tee insert holes 7 are regularly formed on the external sheet 4*a* of the fastening flap 4 along the outside edge of the flap 4. One or more tee pockets 8 are formed between the external and internal sheets 4*a* and 4*b* of the fastening flap 4 at positions corresponding to the tee insert holes 7. These tee pockets 8 are partitioned from each other by sewing the two sheets 4*a* and 4*b* of the flap 4 together along a plurality of stitching lines extending in a direction perpendicular to the axial direction of the glove body 1.

In the glove body 1 of the golf glove, the axial direction extends from the end of the sleeve 2 to the fingers of the glove body 1.

In the present invention, it is preferable to set the number of the tee pockets 8 of the fastening flap 4 to two, three or four. In addition, the tee pockets 8 are partitioned from each other by sewing the two sheets 4*a* and 4*b* of the flap 4 together along the stitching lines "SL" positioned between the pockets 8.

The outside edge of the fastening flap 4 is gently inclined to make the length of the flap 4 vary such that the flap 4 has its shortest length at the first end close to the sleeve 2 of the glove body 1 and its longest length at the second end close to the fingers. Therefore, the tee pockets 8, formed along the lengthwise direction of the flap 4 and extending from the tee insert holes 7 to the edge of the slit 3, have different lengths since the holes 7 are formed along the inclined outside edge of the flap 4. That is., the pocket 8 close to the sleeve 2 has the shortest length, while the pocket 8 close to the fingers has the longest length. It is thus preferred to keep the long tees in the long pockets 8 around the second end of the flap 4 and the short tees in the short pockets 8 around the first end of the flap 4. The positioning of several tees having different lengths is shown in FIG. 3.

In addition, an elastic band 9 is attached on the interior surface of the external sheet 4*a* of the fastening flap 4 in a direction along the tee insert holes 7 of the tee pockets 8 so as to elastically hold the golf tees "T" inserted in the pockets 8. Due to the elastic band 9, it is possible to stably hold the tees "T" without allowing an unexpected removal of the tees "T" from the pockets 8.

Figure 5:
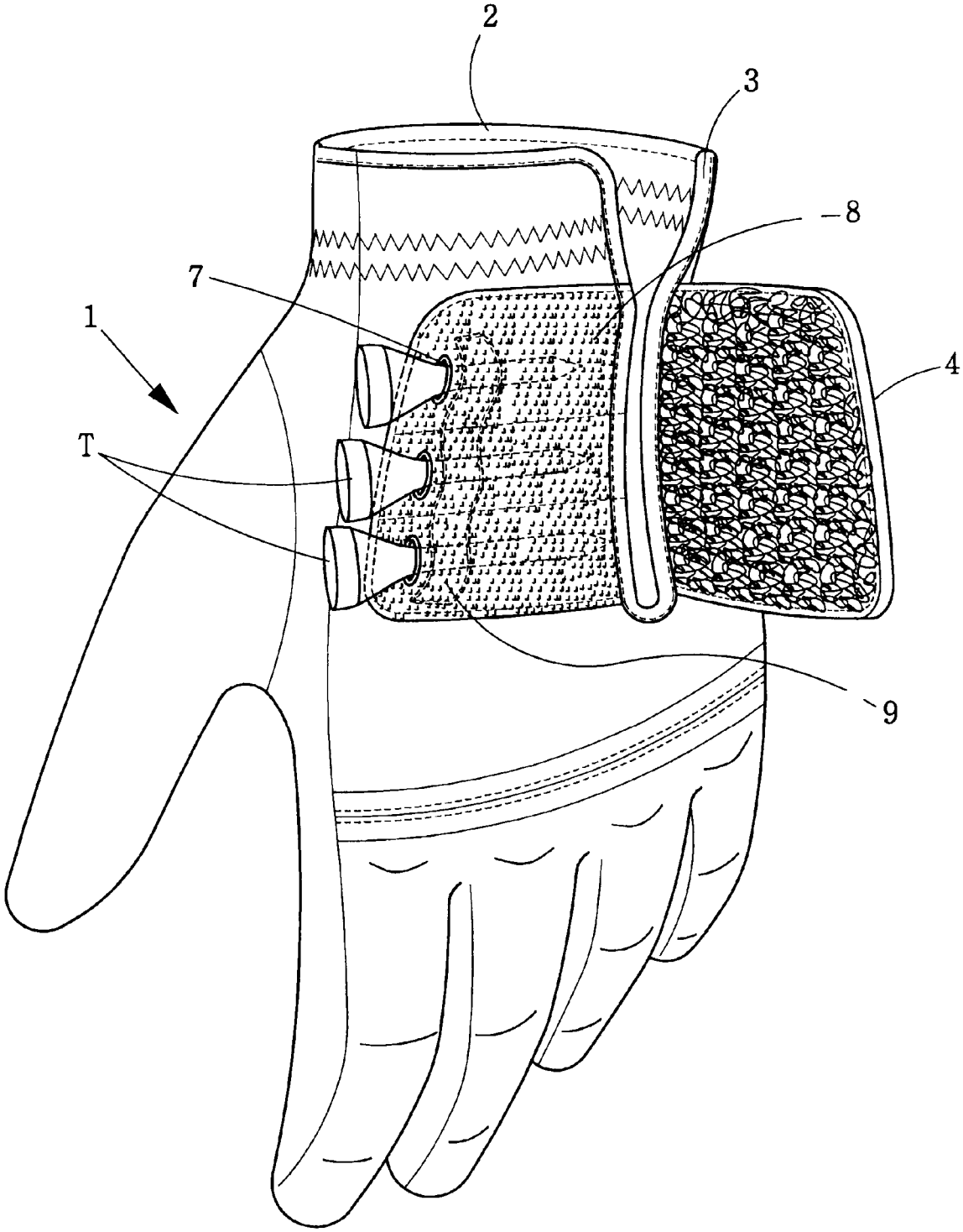
FIG. 5 is a perspective view of a golf glove with a tee pocket in accordance with the second embodiment of the present invention.
Figure 6:
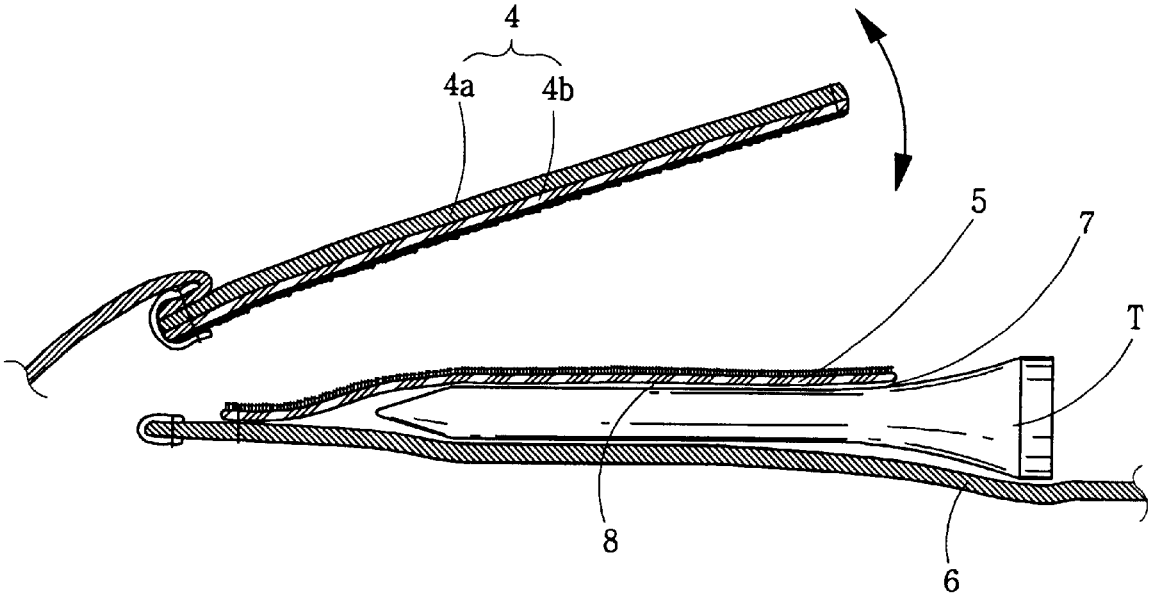
FIG. 6 is a sectional view of the golf glove of FIG. 5, showing a golf tee held in the tee pocket of the golf glove.

FIG. 5 is a perspective view of a golf glove with a tee pocket in accordance with the second embodiment of the present invention. FIG. 6 is a sectional view of the golf glove of FIG. 5, showing a golf tee held in the tee pocket of the golf glove. In the second embodiment, the general shape of the golf glove remains the same as that described for the primary embodiment of FIG. 3, but the tee insert holes 7 and the tee pockets 8 are formed on the flap interlocking patch 5 in place of the fastening flap 4.

That is, one or more tee insert holes 7 are regularly formed on the flap interlocking patch 5 attached to the back of the glove body 1 along the outside edge of the patch 5. Two or more tee pockets 8 are formed between the flap interlocking patch 5 and the surface 6 of the glove body 1 so as to communicate with the tee insert holes 7. The tee pockets 8 extend in a direction perpendicular to the axial direction of the glove body 1.

In this second embodiment, an elastic band 9 is attached on the interior surface of the flap interlocking patch 5 in a direction along the tee insert holes 7. This elastic band 9 elastically holds the golf tees "T" inserted in the tee pockets 8 in the same manner as that described for the primary embodiment.

The operational effect of the golf glove of this invention will be described herein below, with a tee "T" inserted into or taken out of a pocket 8.

When it is desired to store a tee "T" in one pocket 8 of the golf glove according to the primary embodiment worn on the left hand of a right-handed golfer, the golfer holds the head of the tee "T" with his right hand and aligns the sharpened tip of the tee "T" with the tee insert hole 7 of the pocket 8 prior to fully inserting the tee "T" into the pocket 8 through the insert hole 7.

Once the tee "T" is fully inserted into the pocket 8 of the glove as described above, the tee "T" is elastically held by the elastic band 9. The tee "T" is thus less likely to be undesirably removed from the pocket 8 even when the golfer drives or hits the ball or moves on the golf course.

When it is desired to take the tee "T" out of the pocket 8, the left hand of the right-handed golfer with the glove is positioned in front of the upper body of the golfer prior to pulling the tee "T" from the pocket 8 with the fingers of the right hand holding the head of the tee "T". It is thus possible to easily and quickly take the tee "T" out of the glove when necessary.

On the other hand, when it is desired to store a tee "T" in one pocket 8 of the golf glove of FIGS. 5 and 6, the fastening flap 4 is primarily removed from the flap interlocking patch 5, thus opening the fastening band. After the removal of the fastening flap 4 from the interlocking patch 5, the tee "T" is fully inserted into the pocket 8 through the tee insert hole 7 prior to pressing the flap 4 and the patch 5 of the fastening band together to allow them to interlock. In such a case, the heads of the tees "T", stored in the pockets 8 of the glove, are exposed to the atmosphere. Therefore, it is possible for a golfer to easily take the tee "T" out of the pocket 8 with the fingers of the golfer's right hand holding the head of the tee "T".

As described above, the present invention provides a golf glove having one or more tee pockets on its fastening band, consisting of a fastening flap and a flap interlocking patch. The tee pockets may be formed between the internal and external sheets of the double ply fastening flap or may be formed between the surface of the glove body and the flap interlocking patch. The tee pockets of this invention are designed to cover the tees except for their heads, and so the pockets improve the appearance of the glove in comparison with golf gloves having conventional tee holding bands. Since the tee pockets of this invention effectively cover the tees, the pockets allow a golfer to focus his mind upon addressing the head of a club behind the ball, or driving the ball while golfing without being distracted by the tees stored in the glove. This allows the golfer to precisely address the head of a club or drive the ball.

In the golf glove of this invention, the tee pockets are formed on the fastening band without requiring any separate tee holding band, different from conventional golf gloves. The tee pockets thus simplify the production process of the golf glove, and improve productivity while producing the gloves.

In addition, the tee pockets of this invention have different lengths and extend in a direction perpendicular to the axial direction of the glove, thus allowing a golfer to easily and conveniently handle the tees while inserting the tees into the pocket or taking out the tees from the pocket. In addition, since the tees set in the pockets of this invention are arranged in a direction perpendicular to the axial direction of the glove, the sharpened tips of the tees are free from irritating or pressing against the wrist of a golfer when the golfer drives or hits the ball on the course while actively changing his wrist angle.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A golf glove, comprising:

a slit formed on a sleeve of a glove body along an axial direction of said body and allowing a hand of a user to easily pass through the sleeve when putting on or taking off the glove;

a fastening flap mounted to an edge of said slit such that the flap extends in a direction perpendicular to the axial direction of the body;

a flap interlocking patch attached on the surface of said glove body at a position corresponding to the fastening flap, and having fastening means for interlocking with the fastening flap when the fastening flap and the flap interlocking patch are pressed together;

a plurality of tee insert holes regularly formed on the flap interlocking patch along an outside edge of said interlocking patch;

a plurality of tee pockets formed between the flap interlocking patch and the surface of said glove body so as to communicate with the tee insert holes, said tee pockets extending in a direction perpendicular to the axial direction of the glove body; and an elastic band attached on an interior surface of the flap interlocking patch in a direction along the tee insert holes so as to elastically hold a plurality of golf tees inserted in the tee pockets.

* * * * *